US009776822B2

(12) United States Patent
Osada

(10) Patent No.: US 9,776,822 B2
(45) Date of Patent: Oct. 3, 2017

(54) APPARATUS FOR COLLECTING SHEETS

(71) Applicant: Hisashi Osada, Yamanashi-ken (JP)

(72) Inventor: Hisashi Osada, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 14/971,194

(22) Filed: Dec. 16, 2015

(65) Prior Publication Data

US 2016/0176208 A1 Jun. 23, 2016

(30) Foreign Application Priority Data

Dec. 18, 2014 (JP) ..... 2014-255899

(51) Int. Cl.
*B65H 33/08* (2006.01)
*B65H 31/10* (2006.01)
*B65H 31/38* (2006.01)

(52) U.S. Cl.
CPC ..... *B65H 33/08* (2013.01); *B65H 31/10* (2013.01); *B65H 31/38* (2013.01); *B65H 2404/7414* (2013.01); *B65H 2801/06* (2013.01)

(58) Field of Classification Search
CPC ..... B41J 13/08; B41J 13/10
See application file for complete search history.

(56) References Cited

U.S. PATENT DOCUMENTS

2013/0026703 A1* 1/2013 Watanabe ..... B65H 31/26 271/220
2013/0207334 A1* 8/2013 Awano ..... B65H 31/36 270/58.17

FOREIGN PATENT DOCUMENTS

JP 3973836 B2 9/2007
JP 2014-148419 A 8/2014
JP 2014/148419 A * 8/2014

* cited by examiner

*Primary Examiner* — Bradley Thies
(74) *Attorney, Agent, or Firm* — Manabu Kanesaka

(57) ABSTRACT

In a sheet storage apparatus, a shift trajectory between an aligning position on a load surface and a waiting position above the tray is short, and the shift operation does not cause misregistration of aligned sheets, wherein a regulation member strikes and regulates a sheet carried onto the load surface, and a trajectory is set to displace to the regulation member side. The apparatus includes a transport path having a sheet discharge outlet, a tray member disposed on the downstream side of the sheet discharge outlet and having a load surface of sheets, a regulation member disposed in the tray member to regulate an end edge in a transport direction, an aligning member including a side edge engagement surface engaging a side edge in a sheet width direction on the load surface, and a shift section shifting the side edge engagement surface between the waiting position and the aligning position.

10 Claims, 12 Drawing Sheets

APPARATUS FOR COLLECTING SHEETS

RELATED APPLICATIONS

The present application is based on, and claims priority from, Japanese Application No. JP2014-255899 filed Dec. 18, 2014, the disclosure of which is hereby incorporated by reference herein in its entirety.

TECHNICAL FIELD

The present invention relates to a sheet storage apparatus for loading and storing sheets fed from an image formation apparatus or the like on a tray, and more particularly, to improvements in an aligning mechanism for aligning a sheet in a predetermined position on the tray.

BACKGROUND ART

Generally, this type of apparatus is known as an apparatus for storing sheets fed from an apparatus such as an image formation apparatus on the upstream side on a stack tray. In this case, a jog sort mechanism is also known in which sheets are offset and collected on the tray so as to sort the sheets for each copy.

For example, Patent Document 1 discloses a storage mechanism for dropping a sheet fed from a sheet discharge outlet onto a tray where the stack tray is disposed with a level difference formed on the downstream side of a transport path for transporting the sheet, and an aligning mechanism for aligning the stored sheet in a predetermined position with a pair of right and left aligning plates.

In the aligning mechanism in the Document, a pair of right and left aligning plates are moved up and down from a waiting position above the tray to an actuation position below, guide a sheet carried out to above the tray from the sheet discharge outlet in a waiting position (posture), and after moving to the tray, align the sheet in the predetermined position in a width direction in the actuation position (posture).

Patent Document 2 discloses a jogger mechanism for sorting sheets carried onto the tray from the sheet discharge outlet for each copy. A pair of right and left aligning members (plates) are disposed to be able to shift to positions in the sheet width direction, and a mechanism is disclosed which moves the aligning members up and down between the waiting position above the tray and the actuation position on the tray. Then, sheets fed from the sheet discharge outlet are collected and sorted in different positions for each copy.

PRIOR ART DOCUMENT

Patent Document

[Patent Document 1] Japanese Patent Application Publication No. 2014-148419

[Patent Document 2] Japanese Patent Gazette No. 3973836

DISCLOSURE OF INVENTION

Problems to be Solved by the Invention

As described above, in dropping a sheet onto the tray from the sheet discharge path to store, the mechanism is adopted which regulates the position of the sheet in a predetermined position of a load surface for loading sheets to neatly load.

Conventionally, as the mechanism, a regulation member such as a stopper member (fence member) that strikes a sheet to regulate is disposed at a front end portion or rear end portion in the sheet discharge direction, and an aligning member that regulates positions of sheet side edges is disposed in the sheet discharge orthogonal direction (sheet width direction).

For example, a sheet end regulation member which strikes and regulates the sheet is provided in front in the sheet carry-in direction, and concurrently, the load surface is inclined to align the sheet end in the regulation member. Further, in synchronization with sheet carry-in to the load surface, a pair of right and left side edge aligning members align the sheet side edges in reference positions.

In this case, in aligning sheets in different reference positions for each copy to perform a jog sort, a pair of aligning members having side edge engagement surfaces that engage in the sheet side edges are shifted in position from waiting positions above the sheet load surface to aligning positions on the load surface.

Therefore, conventionally, at least one of a pair of right and left aligning members is swung about a rotation axis above the tray as the center, and is caused to reciprocate between the waiting position (waiting posture) and the aligning position (aligning posture). At this point, conventionally, the waiting position is set above the sheet discharge outlet so that the aligning member in the waiting posture does not interfere with a subsequent sheet carried out of the sheet discharge outlet.

Thus, when the aligning member shifts from the waiting posture to the aligning posture while crossing a trajectory of the sheet carried out of the sheet discharge outlet, there has been the need for setting a long transport interval of sheets or shifting the aligning member at a high velocity.

Therefore, since a trajectory of the aligning member shifting from the aligning posture to the waiting posture is the direction opposite to the sheet carry-in direction, the problem arises that sheets aligned on the tray are misaligned and disturbed. In order to prevent the problem, there is the need for shifting the sheet aligning member in the sheet width direction after aligning operation, and subsequently, shifting upward toward the waiting position.

Thus, in the conventional aligning member, the shift trajectory between the waiting position and the aligning position is long, the direction is a direction for causing misregistration of the sheets subsequent to aligning, and therefore, there is the problem that the operation time is long and that the aligning quality deteriorates.

It is an object of the present invention to provide a sheet storage apparatus in which a shift trajectory between the aligning position on the load surface and the waiting position above the tray is short, and the shift operation does not cause misregistration of aligned sheets.

Means for Solving the Problem

To attain the above-mentioned object, in the present invention, a regulation member strikes and regulates a sheet carried onto a load surface, and a trajectory that a side edge engagement surface of an aligning member for engaging in a sheet side edge shifts from an aligning position to a waiting position is set to displace the sheet to the regulation member side.

Further, the configuration will be described specifically. The apparatus is provided with a transport path including a sheet discharge outlet, a tray member that is disposed on the downstream side of the sheet discharge outlet and that includes a load surface of sheets, a regulation member disposed in the tray member to regulate a position of an end edge in a transport direction of a sheet, an aligning member including a side edge engagement surface that engages in a side edge in a sheet width direction on the load surface, and a shift section that shifts the side edge engagement surface between a waiting position and an aligning position.

The shift section sets a shift trajectory of the aligning member so as to shift the aligning member from the aligning position to the waiting position in a shift trajectory that the side edge engagement surface displaces the sheet to the regulation member side.

Advantageous Effect of the Invention

In the present invention, when the aligning member shifts to the waiting position after aligning operation, since the shift trajectory is the direction for displacing the sheet to the front end regulation member side, the sheet is neither misaligned nor disturbed in the posture. Concurrently therewith, in the invention, the load surface is inclined so that the regulation member side is low, the shift trajectory of the aligning member for shifting from the aligning position to the waiting position is set in the inclination direction, it is thereby possible to shorten a shift length of the aligning member, and prompt aligning operation is made possible.

BRIEF DESCRIPTION OF DRAWINGS

FIG. 7A illustrates aligning operation of the aligning member in a printout sheet discharge mode, FIG. 7B illustrates one Embodiment of aligning operation (shift trajectory) by the aligning member, and FIG. 7C illustrates a different Embodiment;

FIG. 8A illustrates the case of aligning sheets in a first reference position, and FIG. 8B illustrates the case of aligning sheets in a second reference position;

FIG. 9A illustrates an initial state in the waiting position in which a sheet is carried out of a sheet discharge outlet, FIG. 9B illustrates a state for supporting a subsequent sheet carried out of the sheet discharge outlet in the waiting position, and FIG. 9C illustrates a state in which the sheet carried out of the sheet discharge outlet is dropped into a load surface;

FIG. 10A illustrates a state for striking the aligned sheet onto a regulation surface with the paddle mechanism in the actuation position, and FIG. 10B illustrates a shift state for returning from the actuation position to the waiting position;

BEST MODE FOR CARRYING OUT THE INVENTION

Figure 1:
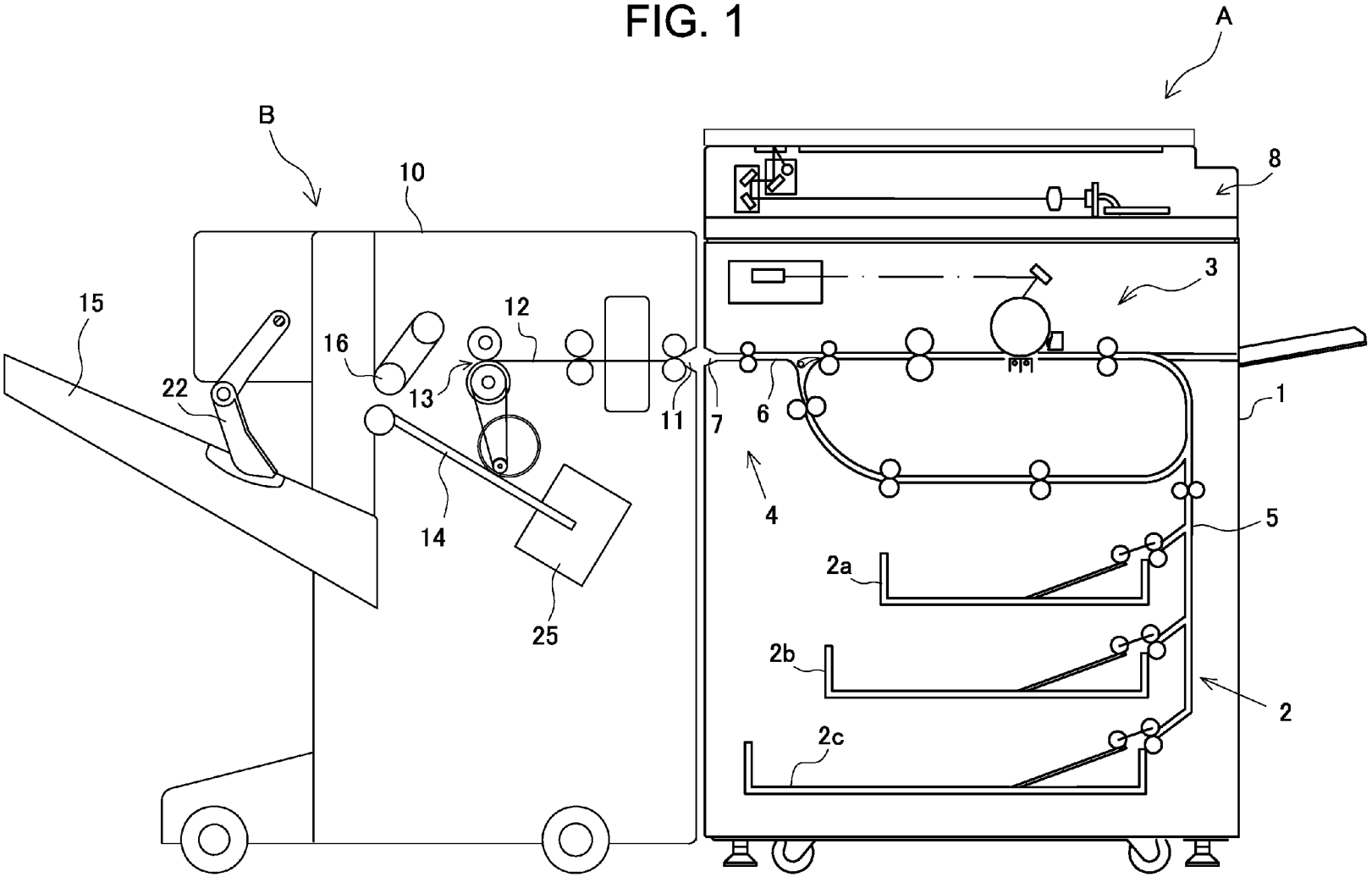
FIG. 1 is an explanatory view of the entire configuration of an image formation apparatus provided with a sheet storage apparatus according to the present invention.

FIG. 1 illustrates a post-processing apparatus B provided with a sheet storage apparatus C according to the present invention and an image formation system. The image formation system shown in the figure is comprised of an image formation apparatus A and the post-processing apparatus B for performing post-processing on a sheet with an image formed, and the sheet storage apparatus C is incorporated into the post-processing apparatus B.

[Image Formation Apparatus]

The image formation apparatus A shown in FIG. 1 is provided with a paper feed section 2, image formation section 3, and sheet discharge section 4 inside a housing 1. For example, the paper feed section 2 is comprised of a plurality of cassettes 2*a*, 2*b*, 2*c* for storing sheets of a plurality of sizes, and a paper feed path 5 for feeding a sheet fed out of each cassette to the image formation section 3 on the downstream side. The image formation section 3 is comprised of an image formation mechanism for forming an image on the sheet. Known as the image formation mechanism (not shown in the figure) are the inkjet image formation mechanism, ink ribbon transfer image formation mechanism, electrostatic image formation mechanism, silk screen image formation mechanism and the like.

The sheet discharge section 4 carries out the sheet with the image formed in the image formation mechanism from a sheet discharge outlet 7 formed in the housing 1. Therefore, the sheet discharge section 4 is comprised of the sheet discharge outlet 7, and a sheet discharge path 6 for guiding the sheet from the image formation section 3 to the sheet discharge outlet. Further, in the image formation apparatus A is disposed a scanner unit 8 for reading an image of an original document sheet, and data obtained by reading the image, or data transferred from an outside apparatus (computer or the like) is stored in an image data storing section (not shown in the figure).

[Post-Processing Apparatus]

The post-processing apparatus B shown in FIG. 1 is comprised of an apparatus housing 10, sheet carry-in path (sheet transport path; the same in the following description) 12 incorporated into the housing, processing tray 14, and stack tray 15. The sheet transport path 12 is provided with a carry-in entrance 11 and a sheet discharge outlet 13, and the carry-in entrance 11 is disposed in a position for receiving the sheet from the sheet discharge outlet 7 of the image formation apparatus A.

Further, on the downstream side of the sheet discharge outlet 13, the processing tray 14 and stack tray (first stack tray; the same in the following description) 15 are disposed while forming level differences, and are arranged in the position relationship for selectively transporting so that the sheet is fed to the processing tray 14 or the stack tray 15 from the sheet discharge outlet 13.

Figure 2:
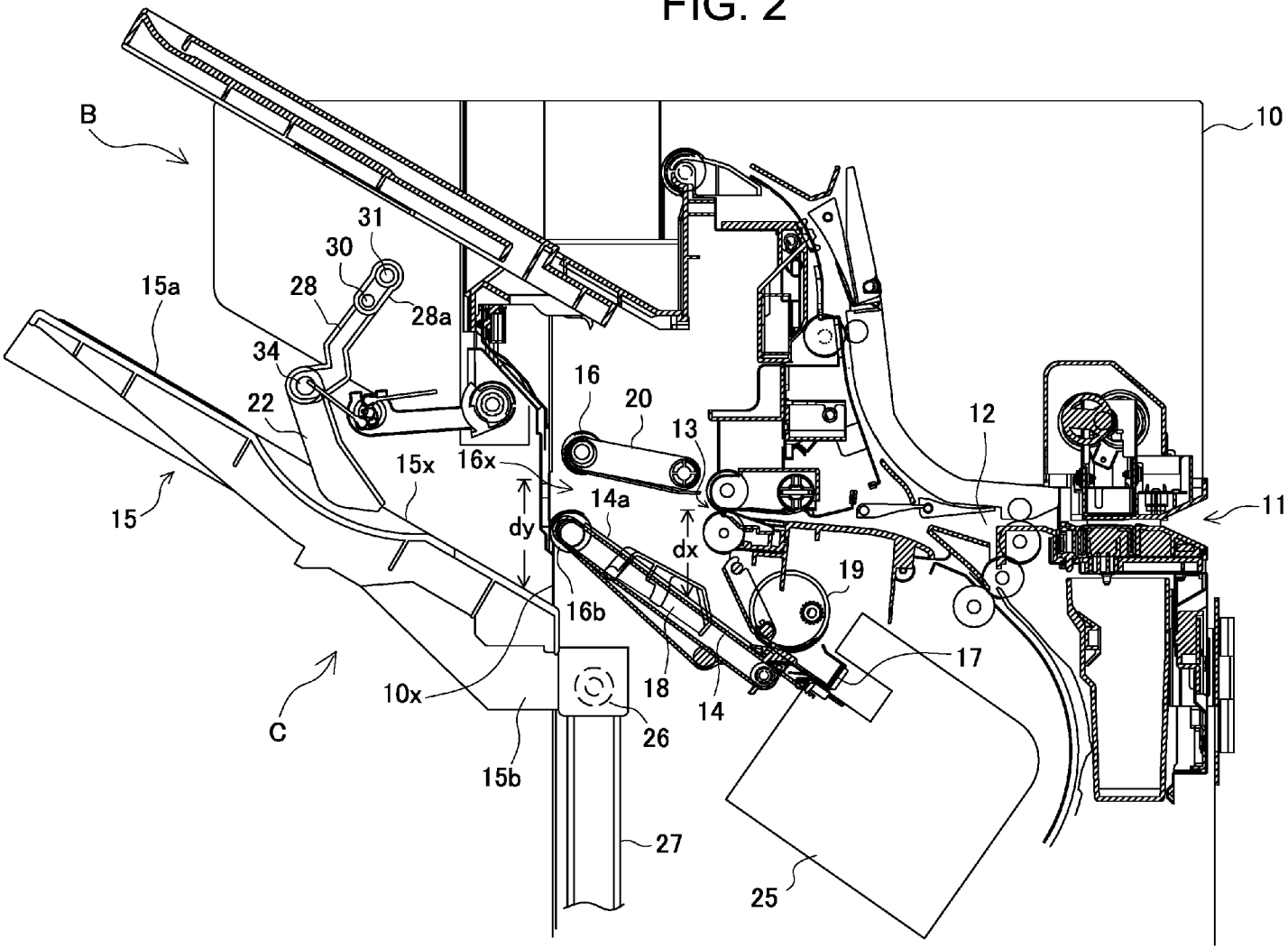
FIG. 2 is an explanatory view of a post-processing apparatus having the sheet storage apparatus of FIG. 1.

As shown in FIG. 2, on the downstream side of the sheet discharge outlet 13, the processing tray 14, and next the stack tray 15 are disposed while being spaced level differences dx, dy (dy≤dx). Between the sheet discharge outlet 13 and the processing tray 14 is disposed a transport roller pair (hereinafter, referred to as up-and-down roller 16, driven roller 16*b*) 16 for guiding the sheet to the processing tray 14 or guiding to the stack tray 15. By rotating the up-and-down roller 16 forward or backward, it is switched for guiding the sheet fed from the sheet discharge outlet 13 to the processing tray 14 or guiding the sheet to the stack tray 15 on the downstream side.

In the processing tray 14 are disposed a paper mount surface 14*a* for loading and supporting sheets, a rear end regulation stopper 17 for regulating an end edge (in the apparatus shown in the figure, rear end edge) of the sheet, a side aligning plate 18 for aligning the width of the sheet on the paper mount surface, and a sheet carry-in rotating body (in the apparatus shown in the figure, caterpillar belt) 19. Further, the up-and-down roller 16 is disposed at an exit end of the processing tray 14.

The up-and-down roller 16 is disposed at an exit end of the paper mount surface 14*a* of the processing tray 14 on the downstream side of the sheet discharge outlet 13, and is able to move up and down between a position for coming into press-contact with the driven roller 16*b* embedded in the processing tray 14, and a separated waiting position. Therefore, the up-and-down roller 16 is supported by a swing bracket 20 attached to an apparatus frame swingably, and is coupled to a forward-backward rotation motor not shown. Then, the swing bracket 20 is coupled to a lift motor, and is moved up and down by forward and backward rotation of the motor.

Further, in the processing tray 14 is disposed a post-processing section (stapler unit) 25 for performing binding processing on a bunch of sheets collected on the paper mount surface 14*a*. The configuration is well known, and therefore, the description thereof is omitted.

The stack tray 15 is comprised of a paper mount tray 15*a* having a load surface (sheet support surface; the same in the following description) 15*x*, and a tray base 15*b* that supports the tray. To the tray base 15*b* is fixed a tow belt 27 wound around a pair of upper and lower pulleys 26 disposed in the apparatus housing 10, and one of the pulleys is coupled to a wind-up motor (not shown in the figure). Accordingly, it is configured that the tray base 15*b* and the paper mount tray 15*a* supported by the base are moved up and down in the load direction of sheets by forward and backward rotation of the wind-up motor.

A level sensor Sr (not shown) for detecting a height position of loaded sheets is disposed above the load surface 15*x*, and whenever a sheet is carried in, detects a paper surface height to control rotation of the wind-up motor. "10*x*" shown in the figure denotes a regulation surface (elevation surface; regulation fence) that regulates an end edge (rear end edge) of the sheet along the load surface 15*x* moving up and down.

[Sheet Aligning Mechanism]

Figure 3:
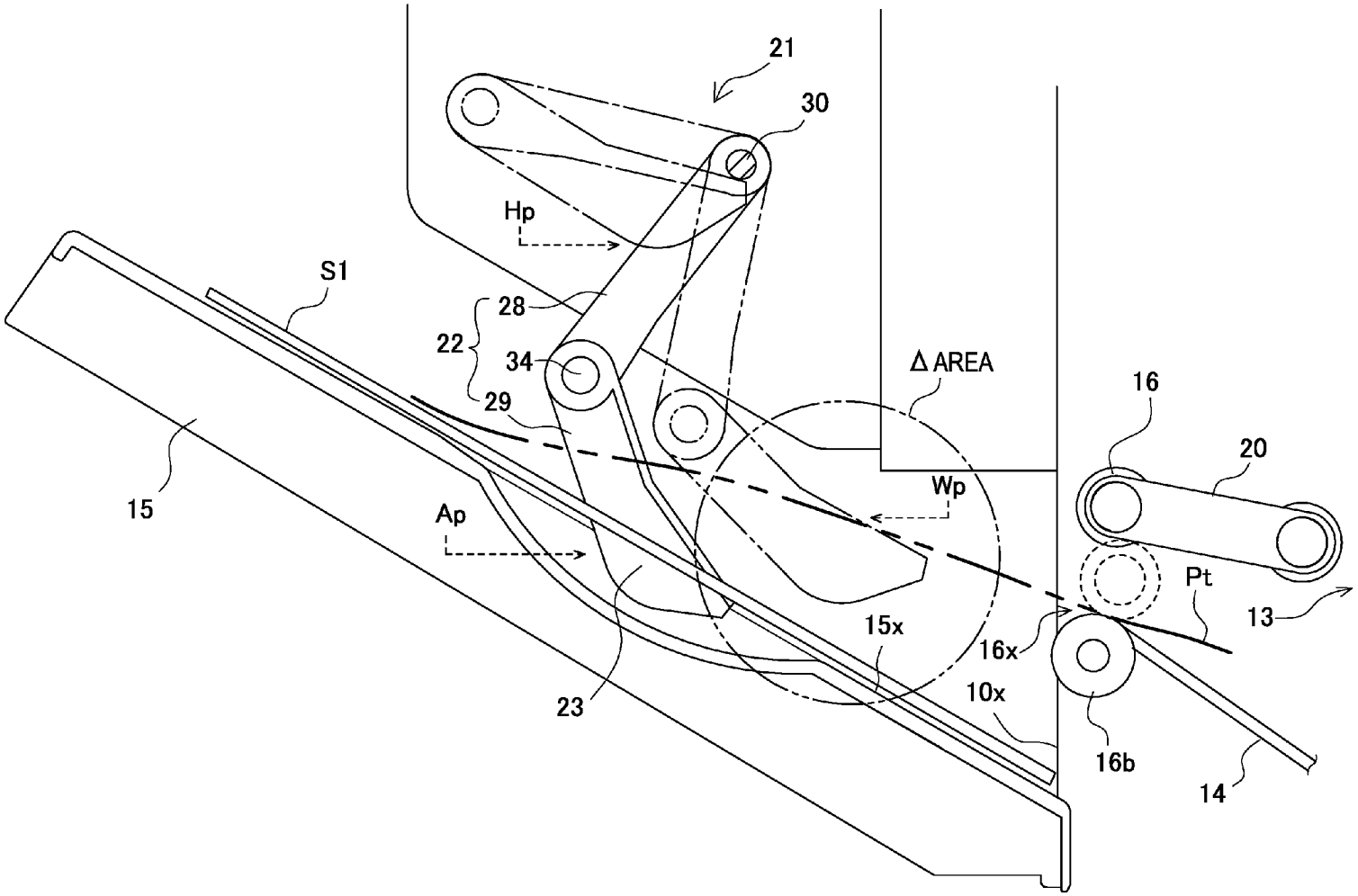
FIG. 3 is an enlarged explanatory view of principal part of the post-processing apparatus of FIG. 2.
Figure 4:
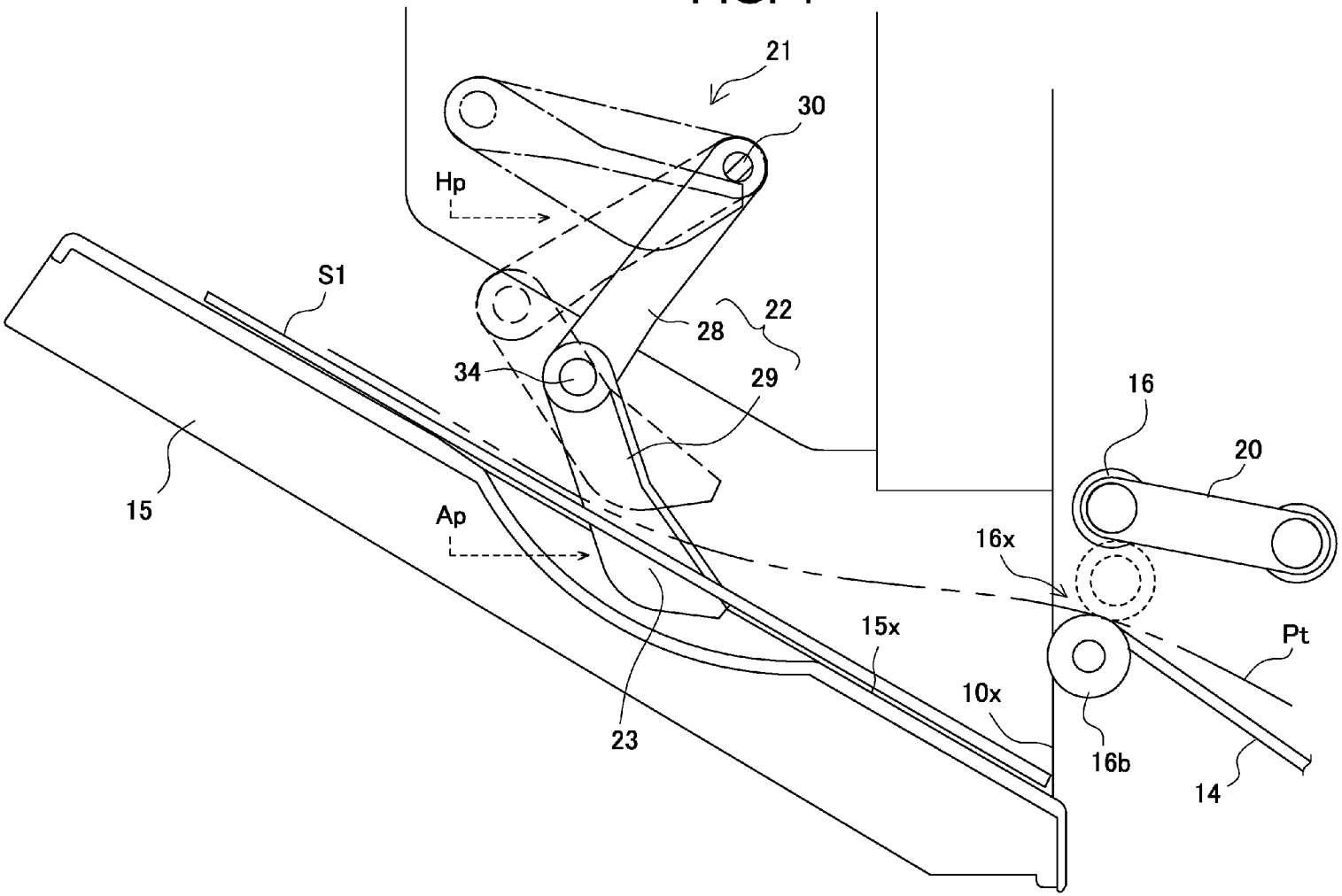
FIG. 4 is an Embodiment of a sheet aligning mechanism different from FIG. 3.

In addition, in the present invention, a reference position refers to a position set (calculated) in a center reference or side reference corresponding to the width-direction size of the sheet, an aligning position refers to a position for positioning the sheet carried onto the tray, and both of the positions are substantially the same position. In the stack tray 15 is disposed a sheet aligning mechanism 21 that aligns the width-direction position of a sheet loaded on the load surface 15*x* in the reference position (aligning position; the same in the following description). The configuration will be described according to FIGS. 3 and 5.

The sheet aligning mechanism 21 is comprised of an aligning member 22 that regulates the position of the side edge in the transport orthogonal direction of a sheet carried in the load surface 15*x*, and a shift section (M1) that shifts the aligning member 22 to positions between a waiting position Wp retracted from a sheet mount surface S1, and the aligning position Ap on the load surface.

The aligning member 22 is comprised of a pair of aligning members 22 (right aligning member 22R, left aligning member 22L) that engage in sheet both side edges on the load surface, or a single aligning member that engages in the other side edge of the sheet with one side edge regulated by the fixed regulation surface (tray frame wall or the like) 10*x*. Hereinafter, a pair of right and left aligning members 22 (right aligning member 22R, left aligning member 22L) shown in the figure will be described. In the case of adopting the Embodiment where a single aligning member is disposed on the load surface, the member is made the same structure as one of the right aligning member 22R and left aligning member 22L described later, and for example, the member for regulating the sheet other side edge is comprised of a tray side frame wall (fixed wall) or the like.

The aligning members 22 are provided with side edge engagement surfaces 23 (right engagement surface 23R, left engagement surface 23L) that engage in the side edges of the sheet. The side edge engagement surfaces 23 are integrally formed with the aligning members (aligning plates) 22 in the Embodiment of FIG. 3, and it is also possible to separate the surfaces from the aligning members 22 and configure so that the surfaces are able to slide-shift in the load direction on the wall surface to fit.

Each of the pair of right and left aligning members 22 is comprised of a base end arm portion 28, and a front end aligning portion 29 (hereinafter, referred to as "wing portion"). The base end arm portion 28 is bearing-supported by a swing main shaft 30 and swing auxiliary shaft 31 disposed in the apparatus frame (not shown in the figure). A turn motor M1 described later is coupled to the swing main shaft 30, and rotates a predetermined angle. The swing main shaft 30 and swing auxiliary shaft 31 are disposed above the load surface 15*x*, and the base end arm portion 28 supported by both of the shafts is disposed to hang to the load surface 15*x* from above.

The swing main shaft 30 is axially supported by the apparatus frame rotatably, and is disposed in the sheet width direction of the load surface 15*x*, and the shaft length is comprised of a shaft member (rod member) longer than the width dimension of the maximum-size sheet. Further, the swing auxiliary shaft 31 is disposed at a distance from the swing main shaft 30 in parallel therewith, and the shafts are integrally supported by a joint member 32. The aligning member 22 is fit-supported by the swing main shaft 30 and the swing auxiliary shaft 31.

Accordingly, the base end arm portion 28 of the aligning member 22 integrally rotates by rotation of the swing main shaft 30 above the load surface 15*x*. Concurrently therewith, a fit portion 28*a* is integrally formed in the base end arm portion 28, and is loosely fitted into the swing main shaft 30 and swing auxiliary shaft 31. The aligning member 22 is loosely fitted into the swing main shaft 30 and swing auxiliary shaft 31, is supported slidably (able to shift to positions) in the sheet width direction, and is coupled to a side shift motor M2 (M3) described later.

The turn motor M2 rotates the swing main shaft 30 a predetermined angle by rotation thereof. By this means, the aligning member 22 attached to the swing main shaft 30 moves up and down between the upper waiting position Wp and the lower aligning position Ap. Further, the left and right side shift motors M2 and M3 respectively move the left aligning member 22L and right aligning member 22R to the left and right in the width direction. Then, a position of a flag 33 disposed in each of the left aligning member 22L and right aligning member 22R is detected with a position sensor Sp1 (Sp2) disposed in the apparatus frame. Using a rotation amount of the side shift motor M2 (M3) from the detection position, the position of the aligning member 22 is shifted to a predetermined position.

The wing portion 29 is comprised of a plate material (plate-shaped material) having the side edge engagement surface 23 that engages in the sheet side edge on the load surface 15*x*, and the end portion thereof is axially supported by the base end arm portion 28 with a couple pin 34. A biasing spring (coil spring; not shown) is wound around the couple pin 34, and the pin is biased in one direction (waiting posture described later) with respect to the base end arm portion 28.

In addition, the case is shown in the figure where the side edge engagement surface 23 is integrally formed (Embodiment where the surface of the plate material engages in the sheet side edge) in the plate material (wing portion) 29. The side edge engagement surface 23 may be comprised of a plate member (slide plate) separated from the wing portion 29 described later to be fitted into the aligning member 22 slidably in the load direction.

Figure 5:
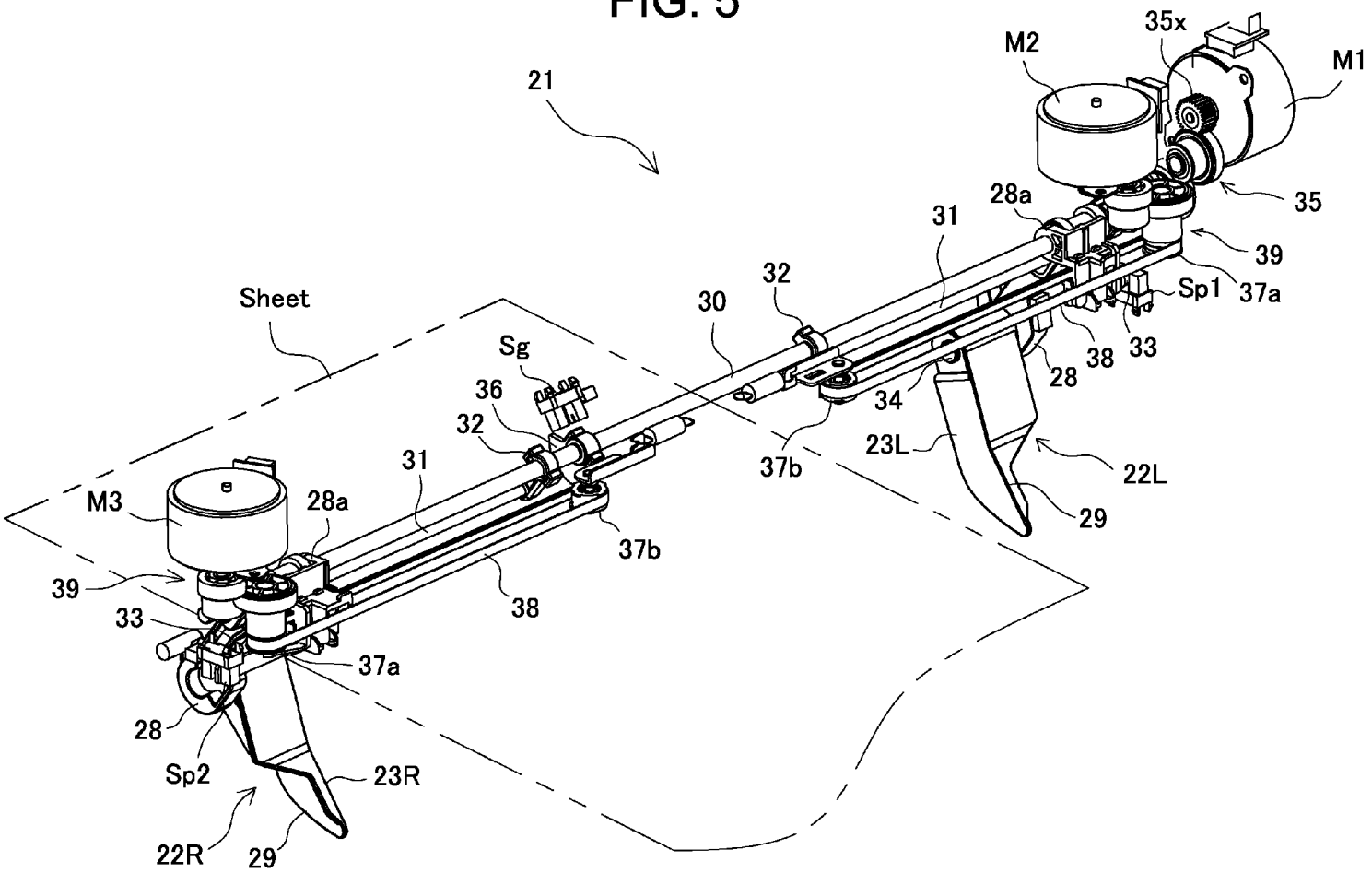
FIG. 5 is a perspective explanatory view illustrating a mechanism of an aligning member and a structure of a shift section in the sheet storage apparatus.

Described next is a drive structure in the sheet aligning mechanism 21. As shown in FIG. 5, the turn motor M1 is coupled to the swing main shaft 30 via a gear reduction mechanism 35. An angle sensor Sg to determine a rotation angle is disposed between the motor rotation shaft 35*x* and the swing main shaft 30. The angle sensor Sg shown in the figure detects the rotation angle of the swing main shaft 30 by the sensor disposed in the apparatus frame detecting a sensor flag 36 fixed to the swing main shaft 30. The sensor flag 36 is formed in the shape of enabling a first angle position (home position), a second angle position (aligning position) and a third angle position (waiting position) to be detected in a counterclockwise direction in FIG. 3.

A pair of pulleys 37*a*, 37*b* are disposed in the apparatus frame (not shown) that supports the swing main shaft 30, and a belt 38 with teeth is looped between the pulleys (linear drive mechanism). The base end arm portion 28 of the aligning member 22 is coupled to the belt 38 with teeth to shift the front end aligning portion (wing portion) 29 to positions in the sheet width direction (aligning direction) on the load surface. Therefore, one (drive pulley 37*a*) of the pulleys is coupled to the side shift motor M2 (M3) via a reduction gear mechanism 39.

The pulleys 37*a*, 37*b*, reduction gear mechanism 39 and side shift motor M2 (M3) are attached to the apparatus frame (not shown in the figure), and the base end arm portion 28 of the aligning member 22 is attached slidably to the swing main shaft 30 and swing auxiliary shaft 31 described previously. Then, by forward/backward rotation of the side shift motor M2 (M3), the aligning member 22 is able to shift in the sheet width direction on the load surface 15*x*, and at the same time, by forward/backward rotation of the turn motor M1 described previously, moves up and down between the waiting position Wp separated from the sheet on the load surface 15*x* and the aligning position Ap for engaging in the sheet side edge.

In addition, in the case of arranging a pair of aligning members 22 to the left and right of the load surface 15*x*, the pulleys 37*a*, 37*b* are disposed in each of the left and right, and left and right drive-side pulleys 37*a* are respectively coupled to the left side shift motor M2 and the right side shift motor M3. In addition, as well as the travel mechanism such as wire and belt disposed between the pulleys, the linear drive mechanism is capable of being comprised of a motion conversion mechanism such as a cam and spline.

[Operation of the Aligning Member]

The operation of the aligning member 22 will be described. The aligning member 22 shifts to positions among a "home position Hp", "waiting position Wp" and "actuation position Ap (aligning position; the same in the following description). During a shift from the waiting position Wp to the actuation position Ap, the aligning member 22 is displaced to a "width-aligning position Awp". In other words, in the aligning member 22, the height position and width-direction position are changed in the order of the home position Hp, waiting position Wp, width-aligning position Awp and actuation position Ap.

Each position will be described.

"Home Position Hp"

The home position Hp is determined in a (width-direction) position which is spaced a predetermined distance (Lhx) away from the side edge in the width direction of the maximum-size sheet, and which is a position (height position spaced a predetermined distance (Lyh) away from the load surface 15*x*) higher than an allowable maximum load amount in the sheet load direction, with reference to the "aligning position Ap on the load surface" described later. In other words, the home position Hp is set at a position (Lhy) higher than the allowable maximum load height on the outer side (Lhx) than the side end edge of the maximum-size sheet loaded on the load surface 15*x*.

Figure 7A:
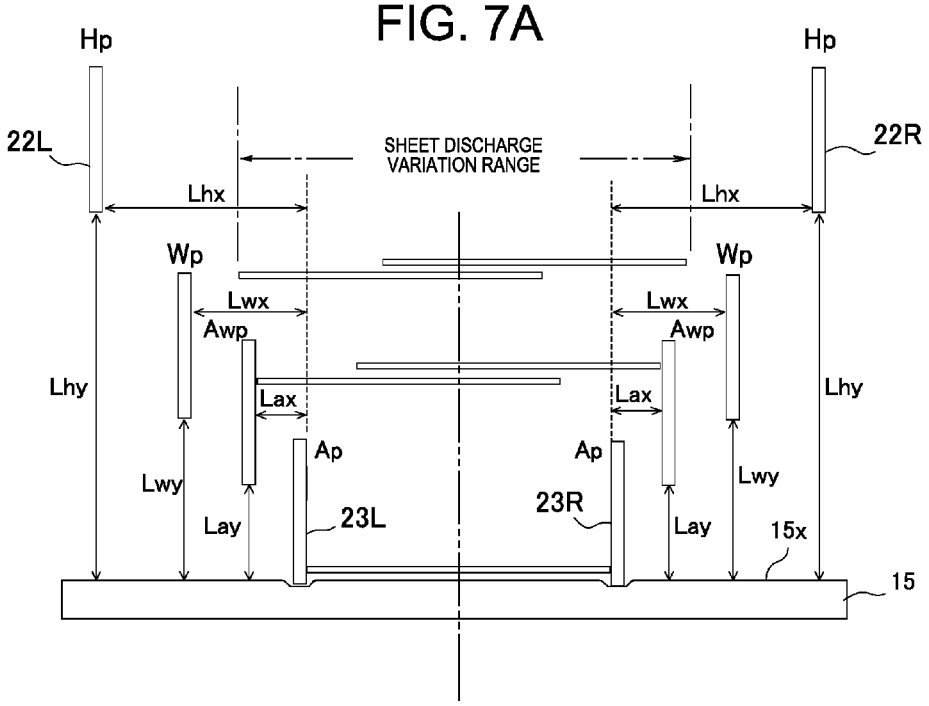
FIGS. 7A to 7C contain explanatory views of sheet aligning operation in the sheet storage apparatus of FIG. 2, where

The height position (Lhy) of the home position Hp shown in the figure is set at a position (chain line in FIG. 3) higher than the sheet discharge outlet 13 of the sheet transport path 12 disposed above the load surface 15*x*, or a sheet discharge outlet 16*x* for carrying out sheets that are carried out of the sheet discharge outlet 13 and that are collected on the processing tray 14, and concurrently, is set on the outer side (see FIG. 7A) of the maximum-size sheet carried out of the transport path.

Moreover, the home position Hp is capable of being set at a position except the above-mentioned position, and further, is also capable of being made the same position as the actuation position Ap or the waiting position Wp.

"Waiting Position Wp"

The waiting position Wp is set at a position that the aligning member 22 is retracted to a non-actuation state from the load surface 15*x*.

The waiting position Wp is required to be (1) an area for enabling a displacement (shift) from the actuation position Ap to be implemented in a short time, (2) an area that does not interfere with a subsequent sheet which is carried in the load surface 15*x* from the sheet transport path 12, and the like.

Therefore, the waiting position Wp shown in the figure is disposed in an area between a path trajectory of the sheet carried out to the load surface 15*x* from the sheet discharge outlet 13 and the load surface. The path trajectory Pt is formed of a switchback path for reversing the transport direction after the sheet rear end is carried out of the sheet discharge outlet 13, and carrying in the load surface 15*x*. Therefore, the waiting position Wp is set in the area (delta area A shown in the figure) formed at midpoint of the trajectory that the sheet is reversed in the transport direction and moves to the load surface 15*x*. By this means, the waiting position Wp does not interfere with discharge of the subsequent sheet, and is a position near the actuation position (load surface 15*x*).

"Actuation Position Ap"

The actuation position Ap (aligning position; the same in the following description) is beforehand set on the load surface corresponding to the sheet size. This position adopts a method (center reference) of setting the reference position for positioning a sheet side edge position corresponding to the sheet size in a center reference, or a method (side reference) of setting the reference position for positioning a sheet side edge position corresponding to the sheet size in a side reference.

Then, the actuation position Ap is determined in a position (width direction LaX, height direction Lay="0") coinciding with the aligning position (reference position for aligning sheets) set on the load surface 15*x*. Accordingly, the width-direction position of the actuation position Ap is set at a position for matching the sheet side edge with the reference position (Lax), and this position is set in the center reference or side reference for each sheet size. Further, the height position is set substantially in the same plane as the load surface 15*x*.

Figure 8A:
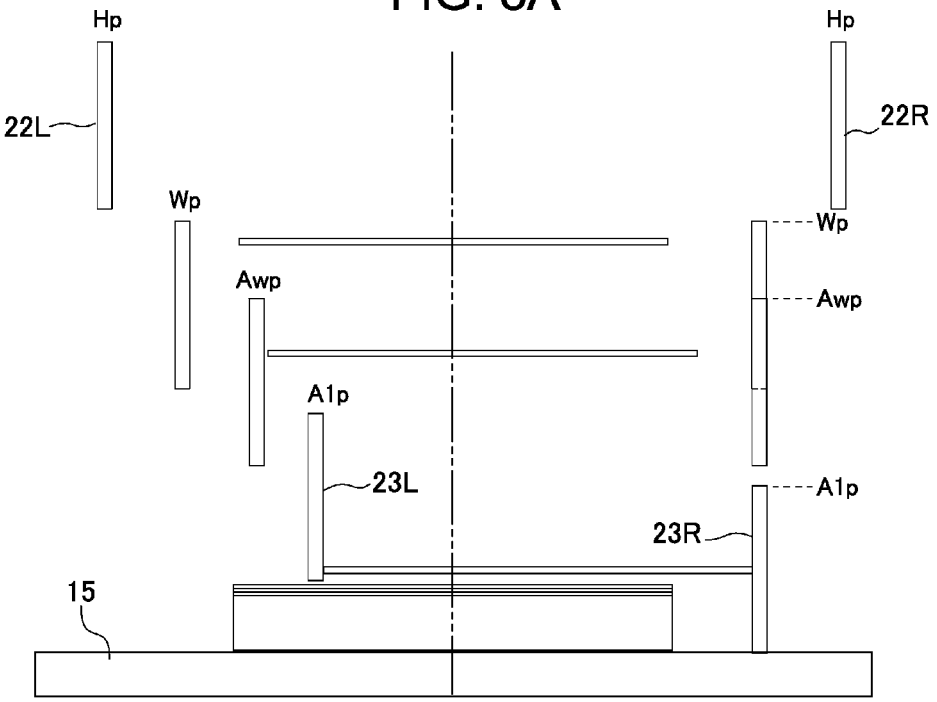
FIGS. 8A and 8B contain explanatory views of aligning operation in a jog sort mode of the sheet storage apparatus of FIG. 2, where
Figure 8B:
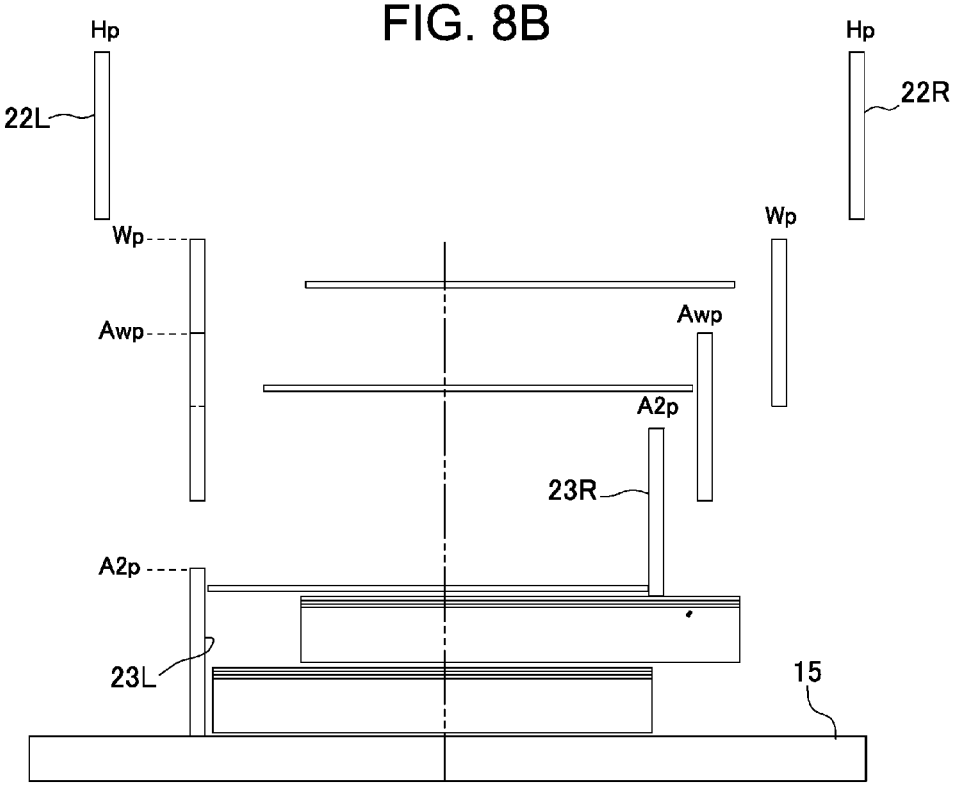

Further, as the actuation position Ap of the aligning member 22, in the case of executing a jog sort mode for collating and collecting sheets in different positions on the load surface 15*x*, as shown in FIGS. 8A and 8B, a first reference position (Ap1) and a second reference position (Ap2) are set at a plurality of different positions on the load surface 15*x*.

"Width-Aligning Position Awp"

The width-aligning position Awp is set in a position relationship for "falling (landing) onto the load surface 15*x* while following a sheet dropped from the sheet discharge outlet 16*x* and engaging in the side edge to shift to positions (width-align) in the width direction" between the waiting position Wp and the actuation position Ap.

In other words, the width-aligning position Awp is set at (1) a width-direction position Lbx (Lbx<Lwx) for aligning the width of the side edge of the dropped sheet to be close to the reference position, from the waiting position Wp (width direction Lwx, height direction Lwy) and (2) a position Lby (Lby<Lwy) downward to the load surface 15*x* side by following the dropped sheet, from the height-direction position (Lwy) of the waiting position Wp.

For example, the sheet rear end is detected with the sheet discharge sensor Se2 of the sheet discharge outlet 13, and from the detection signal, immediately before the sheet lands onto the load surface S1 (onto the uppermost sheet) (for a period during which the sheet starts to drop and lands), the height-direction position of the aligning member 22 is shifted from the waiting height (Lwy) to the width-aligning height (Lby).

Although operation of the aligning member 22 will be described later, downward operation and width-direction shift operation of the aligning member 22 is started at timing at which the sheet passes through the sheet discharge outlet 13 (after the sheet starts to drop from the sheet discharge outlet 16*x*) with the detection signal from the sheet discharge sensor Se2. Then, the operation velocity is set at optimal timing at which the side edge engagement surface 23 engages in the sheet side edge to shift for width aligning in the width direction before the sheet dropped from the sheet discharge outlet 16*x* lands onto the uppermost sheet of the load surface 15*x*.

Further, it is possible to set the above-mentioned waiting position Wp at a position for guiding the lower surface of the sheet carried out of the sheet discharge outlet 13 or sheet discharge outlet 16*x*. In this case, the width-direction position Lwx is set to be shorter (at a narrower area) than the width size of the sheet transported from the sheet discharge outlet 13 or sheet discharge outlet 16*x*, and the height-direction position Lwy is matched with the height position of the sheet carried out of the sheet discharge outlet 13 or sheet discharge outlet 16*x*.

From the foregoing description, a pair of right and left aligning members 22, or the aligning member 22 disposed in one of the right and left reciprocates among the home position Hp, waiting position Wp and actuation position Ap, and is displaced to the width-aligning position Awp for width-aligning the sheet from the sheet discharge posture to the reference position side during a shift from the waiting position to the actuation position.

Described next is timing for displacing the aligning member 22 from the waiting position Wp to the width-aligning position Awp. The operation is capable of adopting any of the following aspects.

The first aspect is to operate the aligning member 22 in the order of (1) the waiting position Wp, (2) the width-aligning position (for matching the width-direction position with the reference position), (3) downward operation for causing landing onto the load surface 15*x* and (4) return to the waiting position Wp. In other words, the side edge engagement surface 23 of the aligning member 22 width-aligns and shifts the sheet to coincide with the reference position, from the waiting position Wp, and next, by falling while following a drop of the sheet, causes the sheet side edge to land into the reference position on the load surface.

The second aspect is to operate the aligning member 22 in the order of (1) the waiting position Wp, (2) width-aligning operation and downward operation (for moving the engagement surface downward while shifting in the width direction), (3) causing landing into the aligning position Ap, and (4) return to the waiting position Wp. In other words, the side edge engagement surface 23 of the aligning member 22 causes the sheet side edge to land into the reference position on the load surface, by performing a shift in the width direction from the waiting position Wp and downward operation following a drop of the sheet.

The third aspect is to operate the aligning member 22 in the order of (1) the waiting position Wp, (2) concurrent execution of width-aligning operation and downward operation, (3) landing into a position different from the aligning position Ap, (4) shift to the aligning position Ap, and (5) return to the waiting position Wp. In other words, the side edge engagement surface 23 of the aligning member 22 executes a shift in the width direction from the waiting position Wp and downward operation following a drop of the sheet, causes the side edge of the sheet to land into a position different from the reference position on the load surface, and subsequently, is shifted in the width direction to position the sheet side edge in the reference position.

[Paddle Mechanism]

Figure 6A:
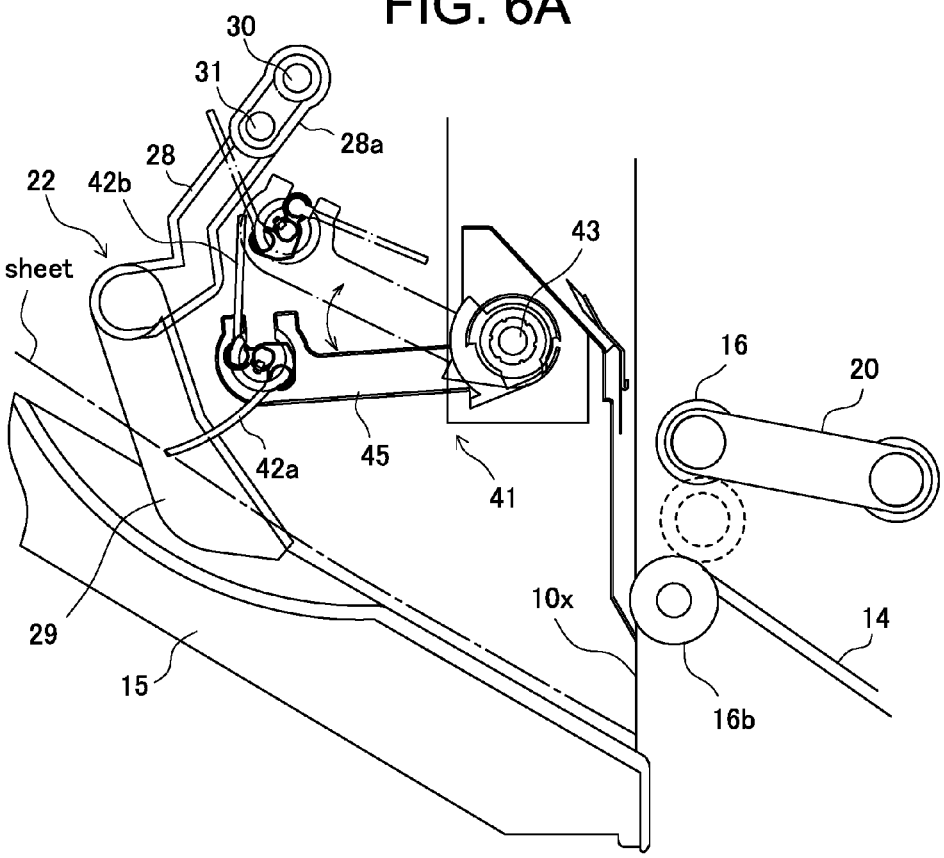
FIGS. 6A and 6B are structure explanatory views of a paddle mechanism in the sheet storage apparatus.
Figure 6B:
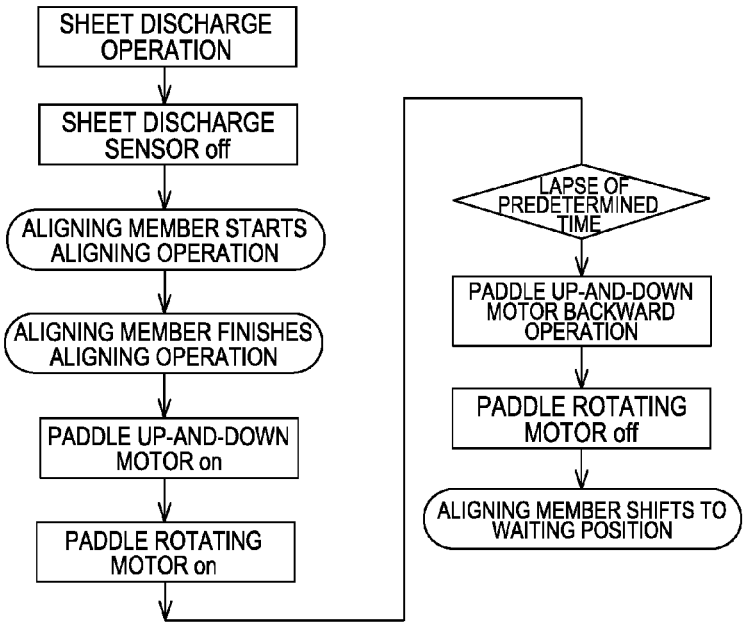

A paddle mechanism shown in FIGS. 6A and 6B will be described. A paddle mechanism 41 is comprised of elastically deformable paddle wings 42*a*, 42*b*, a rotating base shaft 43 for supporting the wings, a paddle rotating motor M4 (not shown) for rotating the rotating base shaft, a transmission belt 44 (not shown) for transferring the rotation to the rotating base shaft 43, a swing lever 45 for swinging the rotating base shaft 43 in the vertical direction, and a paddle up-and-down motor M5 for swinging the lever by a predetermined angle.

Then, in rotating the swing lever 45 by rotation of the paddle up-and-down motor M5, the paddle wings 42*a*, 42*b* move up and down between a waiting position (dashed-line state in FIG. 6A) above the load surface and an actuation position (solid-line state in FIG. 6A) on the load surface. Concurrently therewith, by rotation of the paddle rotating motor M5, the paddle wings 42*a*, 42*b* shift (kick) the sheet aligned on the load surface by the aligning member 22 toward the regulation surface 10*x*.

In other words, a control section 50 described later performs width-alignment on the sheet toward the aligning position Ap with the aligning member 22, before the sheet carried out of the sheet discharge outlet 16*x* drops onto the load surface 15*x*, and strikes and aligns the sheet landing onto the load surface 15*x* to the regulation surface 10*x* with the paddle member 41, while regulating the side edge with the aligning member 22. Then, after the operation, the section 50 returns the paddle wings 42*a*, 42*b* to the waiting position, and then, returns the aligning member 22 to the waiting position Wp.

[Control Configuration]

Figure 11:
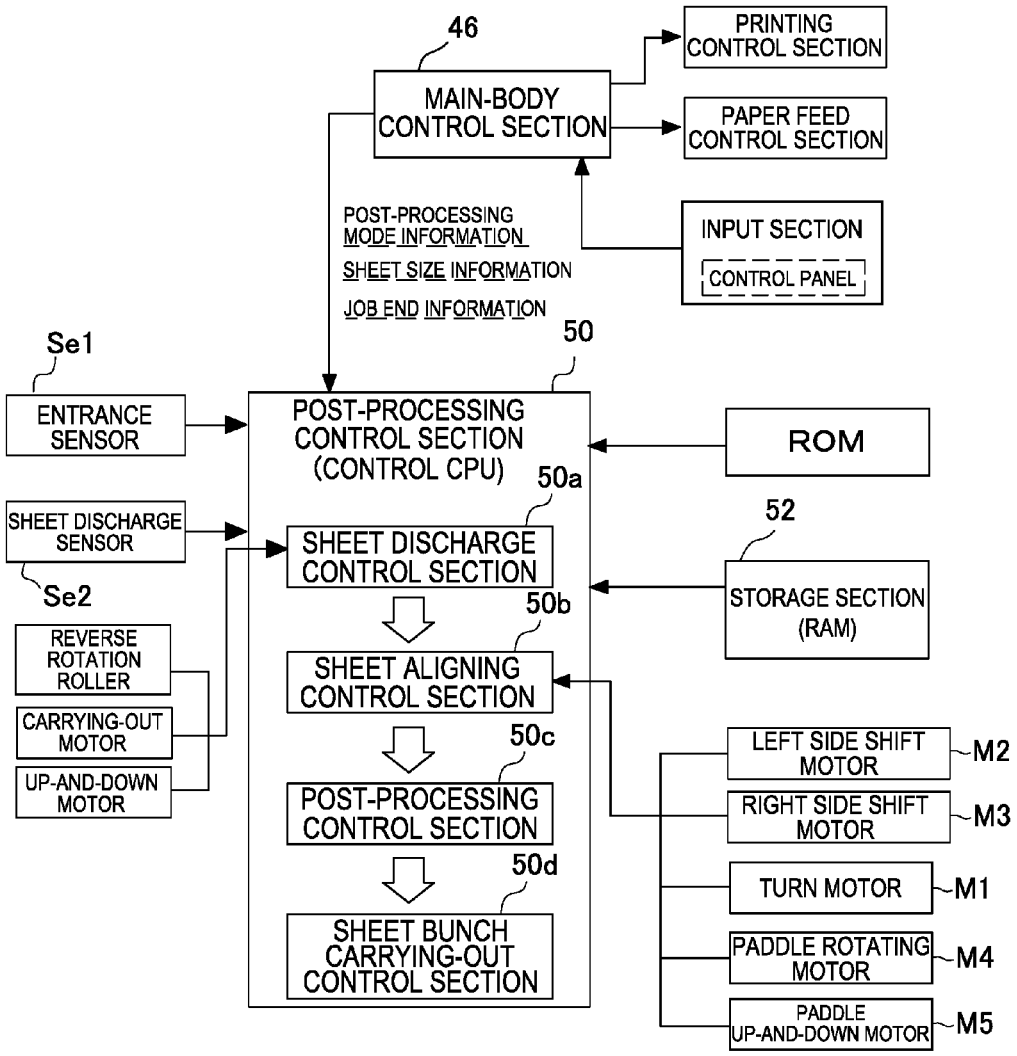
FIG. 11 is an explanatory view of a control section in the sheet storage apparatus.

A control configuration of the post-processing apparatus B in FIG. 1 will be described next, according to a block diagram of FIG. 11. A control section of the post-processing apparatus B is comprised of a control CPU 50, and controls post-processing operation according to control data stored in RAM 52. The post-processing operation is set for "printout mode", "post-processing mode" and "jog sort mode".

The control CPU 50 (hereinafter, simply referred to as the control section) is provided with a sheet discharge control section 50*a* to receive a sheet carried out of the upstream image formation apparatus A in the sheet transport path 12, a sheet aligning control section 50*b*, a post-processing control section 50*c*, and a sheet bunch carrying-out control section 50*d*. The sheet discharge control section 50*a* controls a drive motor so as to transport the sheet carried in the sheet transport path 12 toward the sheet discharge outlet 13 with a sheet discharge roller.

Concurrently therewith, when the sheet front end is carried out of the sheet discharge outlet 13, the sheet discharge control section 50*a* causes the up-and-down roller 16 to wait in a waiting position, brings the rollers into press-contact with each other after the sheet front end passes through, and after rotating the roller in the sheet discharge direction, reverses the transport direction of the roller at timing at which the sheet rear end passes through the sheet discharge sensor Se2, or at timing at which a predetermined time has elapsed since the passage.

The sheet aligning control section 50*b* controls the "sheet carrying-out mechanism" and "sheet aligning mechanism" described previously, corresponding to the post-processing mode (straight sheet discharge mode and staple binding mode) sent from a main-body control section 46. The sheet carrying-out mechanism executes up-and-down operation and rotation operation of the up-and-down roller 16 described previously, and the aligning mechanism 21 controls the side shift motors M2, M3 and turn motor M1. Therefore, the sheet aligning control section 50*b* is coupled to a driver circuit of each of motors so as to transfer command signals to the side shift motors M2, M3, up-and-down motor of the up-and-down roller 16 and carrying-out motor.

The post-processing control section 50*c* controls each unit corresponding to post-processing such as staple binding, punching, and stamping. In the staple unit (post-processing section) 25 shown in the figure, after the last sheet is carried in the processing tray 14 with a jog end signal and the operation for aligning the width direction of the sheet is performed, the control section 50 transmits a start signal to a drive motor of the staple unit 25. Upon receiving this signal, the staple unit 25 executes binding operation, and after finishing the operation, transmits an end signal to the control section 50.

Upon receiving the end signal from the staple unit (post-processing section) 25, the sheet bunch carrying-out control section 50*d* brings a bunch of sheets on the processing tray 14 into press-contact with the up-and-down roller 16, and rotates the roller in the direction of the stack tray 15. By this operation, the bunch of sheets on the processing tray 14 is carried out of the sheet discharge outlet 16*x*, and is stored in the stack tray 15 on the downstream side.

The post-processing mode is to collate and collect sheets fed from the sheet transport path 12 on the processing tray 14 to perform binding processing, and carries out a bunch of sheets subjected to the binding processing from the sheet discharge outlet 16*x* to store in the stack tray 15. Further, the "printout mode" is to carry out a sheet fed to the sheet transport path 12 from the sheet discharge outlet 16*x* via the sheet discharge outlet 13 to collect in the stack tray 15. At this point, the aligning member 22 aligns the sheet side edge in the beforehand set reference position. Furthermore, the "jog sort mode" is to carry out sheets fed to the sheet transport path 12 from the sheet discharge outlet 16*x* via the sheet discharge outlet 13 to collect in the stack tray 15. At this point, the aligning member 22 positions sheets in different positions of the first reference position (Ap1) and the second reference position (Ap2) for each group (for each copy).

Figure 12:
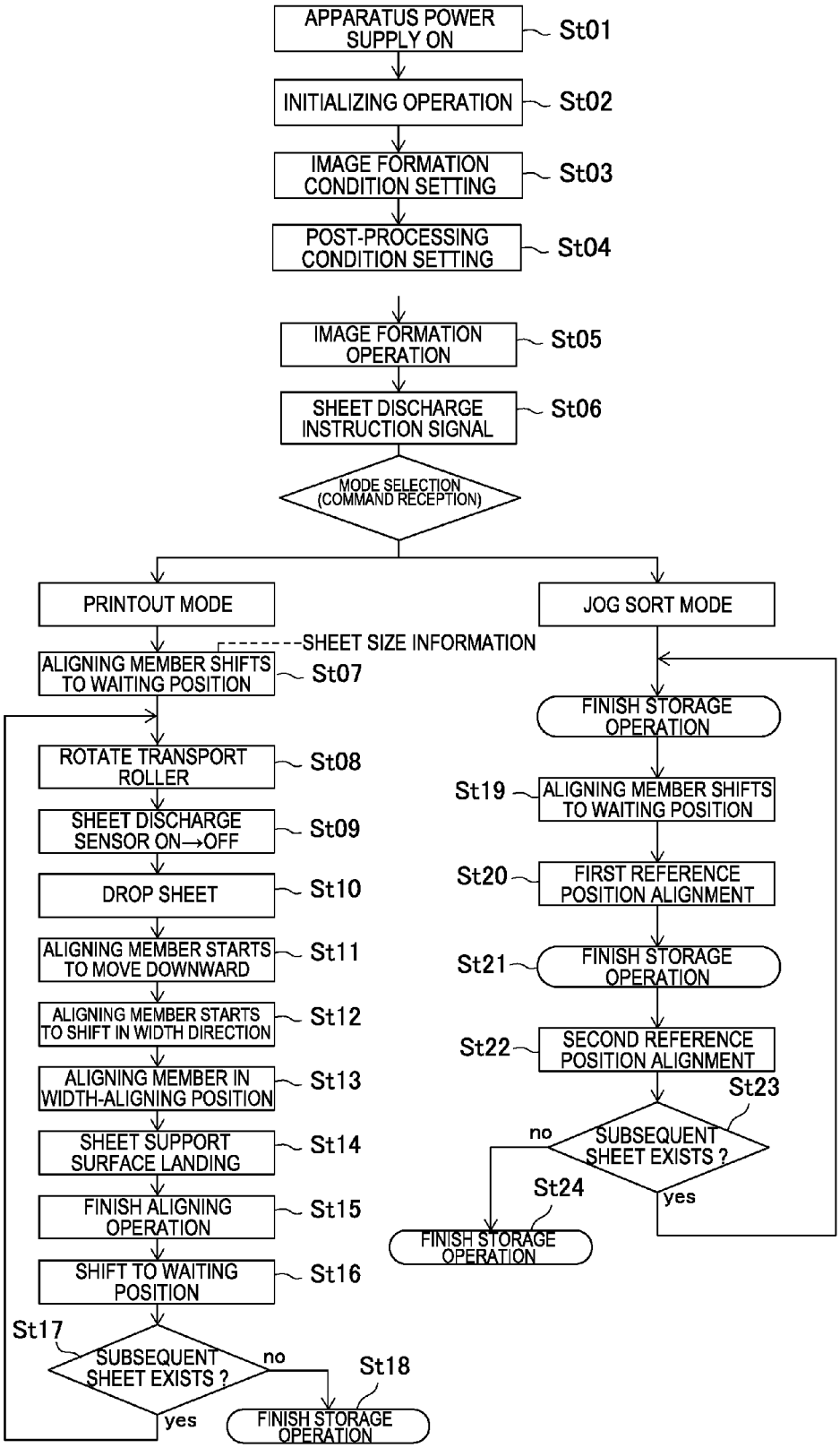
FIG. 12 is a flowchart illustrating a procedure of sheet storage operation in the sheet storage apparatus.

The operation of the control section 50 in the printout mode and jog sort mode will be described according to a flowchart shown in FIG. 12. When an apparatus power supply is turned to ON (St01), the control section 50 executes initializing operation (St02). The initializing operation is to position the aligning member 22 in the home position Hp. The home position Hp is set above an allowable maximum load amount on the outer side of the width-direction length of the maximum-size sheet.

The control section 46 of the image formation apparatus A sets the post-processing condition (mode) concurrently with setting of image formation conditions (St03, St04). The apparatus shown in the figure is in the "printout mode", "jog sort mode" and "staple binding mode", and in each of the printout mode and the jog sort mode, carries out sheets, which are carried out of the sheet discharge outlet 16*x* via the sheet discharge outlet 13, to the stack tray 15. Further, in the staple binding mode, the apparatus carries out sheets to the processing tray 14 from the sheet discharge outlet 13.

Next, after setting of the image formation conditions and operation mode, the control section 46 of the image formation apparatus A executes image formation operation (St05), and transmits a sheet discharge instruction signal (St06) to the control section 50 of the post-processing apparatus B. Concurrently therewith, the section 46 transmits size (including the width-direction length) information of the sheet to perform image formation, and when finishing a series of the image formation operation, transmits a job end signal.

"Printout Mode"

In the printout mode, with the command signal of the post-processing mode and the sheet size information, the control section 50 shifts the position of the aligning member 22 to the waiting position Wp from the home position Hp. This operation is performed with the left and right side shift motors M2, M3 and rotation control (St07).

Upon receiving the sheet discharge instruction signal, the control section 50 rotates the transport roller of the sheet transport path 12 (St08). Then, the sheet fed from the image formation apparatus A is fed to the sheet transport path 12 from the carry-in entrance 11, and is transported to the sheet discharge outlet 13. At this point, an entrance sensor Se1 and the sheet discharge sensor Se2 issue detection signals of the sheet front end and rear end.

Next, when the sheet discharge sensor Se2 changes "from the ON state to the OFF state" (St09), the control section 50 judges as a state in which the sheet is carried out of the sheet discharge outlet 16*x* via the sheet discharge outlet 13 and is dropped toward the load surface 15*x* (St10). Then, the control section 50 moves the aligning member 22 downward from the waiting position Wp toward the actuation position Ap (St11). In tandem with the operation, the control sections 50 shifts the left and right aligning members 22L, 22R from the waiting position Wp toward the aligning position Ap for width-alignment (St12).

Figure 9A:
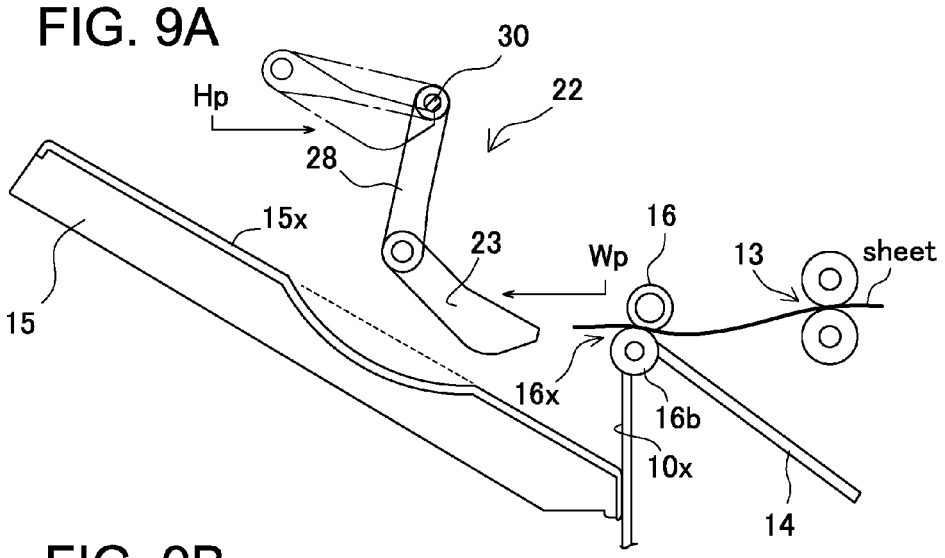
FIGS. 9A to 9C illustrate posture shift states between a waiting position and an actuation position of the sheet aligning member, where
Figure 9B:
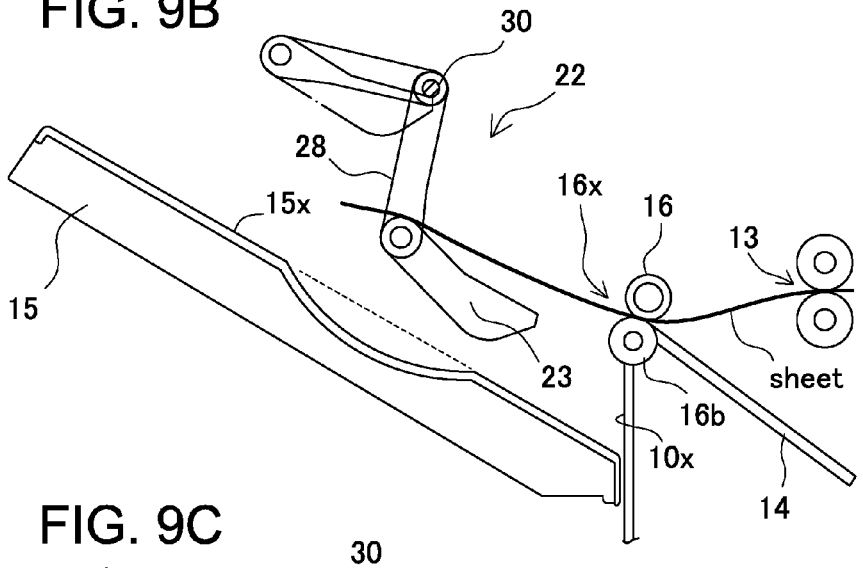
Figure 9C:
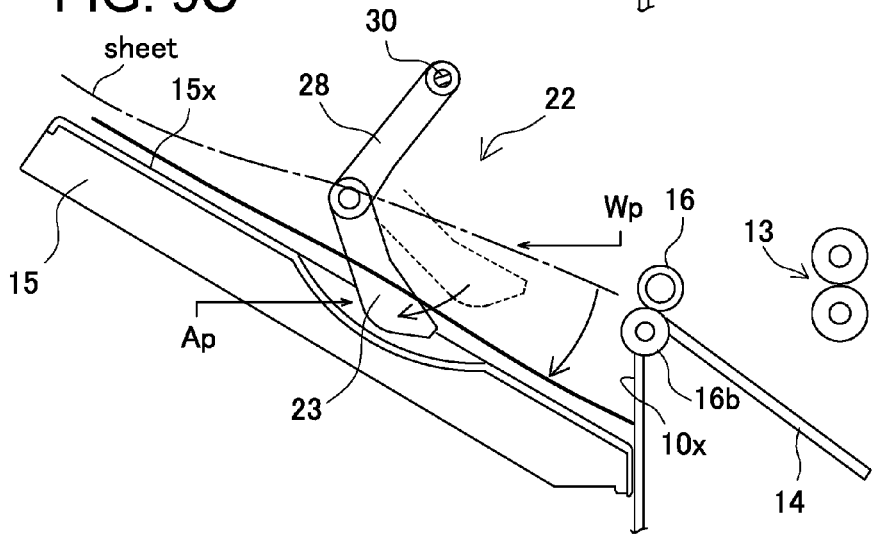

The operation states of the aligning member 22 are shown in FIGS. 9A to 9C, and the member 22 waits for a sheet carried out of the sheet discharge outlet 13 in the waiting position Wp (see FIGS. 9A and 9B). Then, for a period during which the sheet is carried out of the sheet discharge outlet 16*x*, the aligning member 22 supports the sheet lower surface (FIG. 9B). At timing at which the sheet rear end passes through the sheet discharge outlet 16*x*, the aligning member 22 shifts toward the actuation position Ap from the waiting position Wp (FIG. 9C). At this point, in the aligning member 22, the engagement surface 23 shifts the sheet side edge in the direction of the reference position for width-alignment.

Figure 10A:
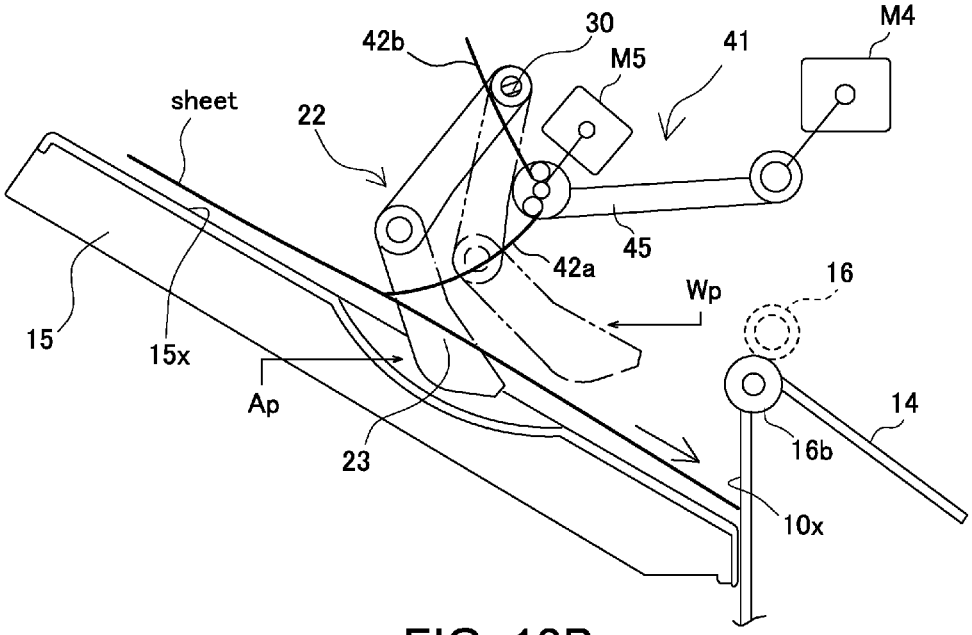
FIGS. 10A and 10B illustrate posture shift states between the waiting position and the actuation position of the sheet aligning member, where
Figure 10B:
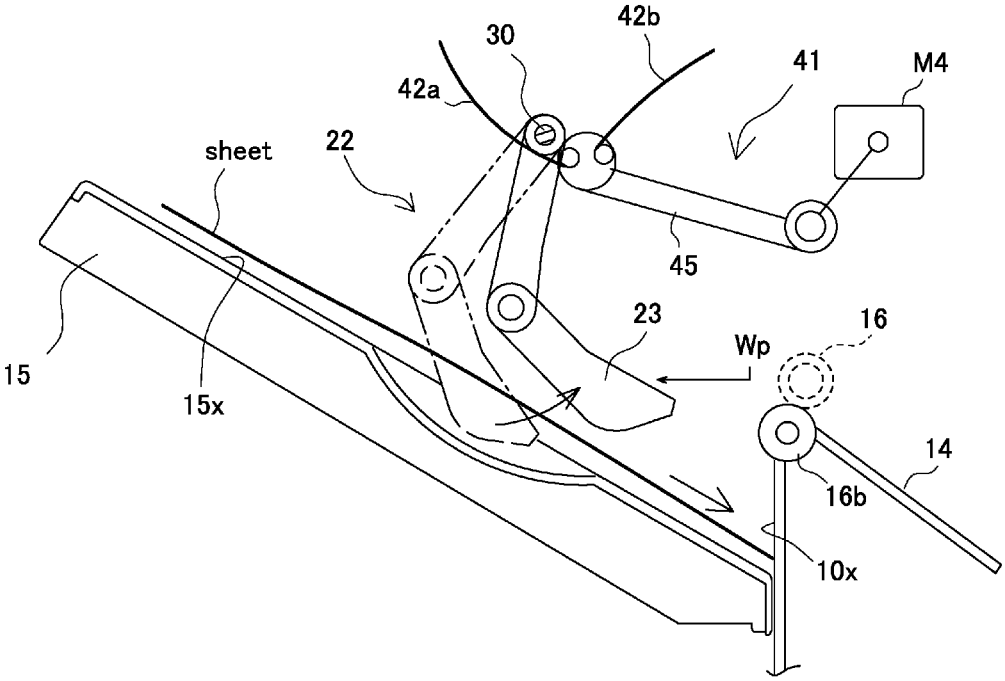

Next, in a state in which the aligning member 22 is locked in the actuation position Ap, the control section 50 actuates the paddle mechanism 41. For actuation of the paddle mechanism 41, the section 50 moves the swing lever 45 in the upper waiting position downward with the paddle up-and-down motor M5, and rotates the paddle wing 42 with the paddle rotating motor M4. Then, the sheet is shifted by the paddle wing 41 until the sheet strikes the regulation surface 10*x* (see FIG. 10A). After actuation of the paddle mechanism 41, the aligning member 22 returns from the actuation position Ap to the waiting position Wp. At this point, the side edge engagement surface 23 engaging in the sheet side edge shifts in the arrow direction shown in FIG. 10B, and provides the sheet with a force for displacing to the regulation surface 10*x* side.

Figure 7B:
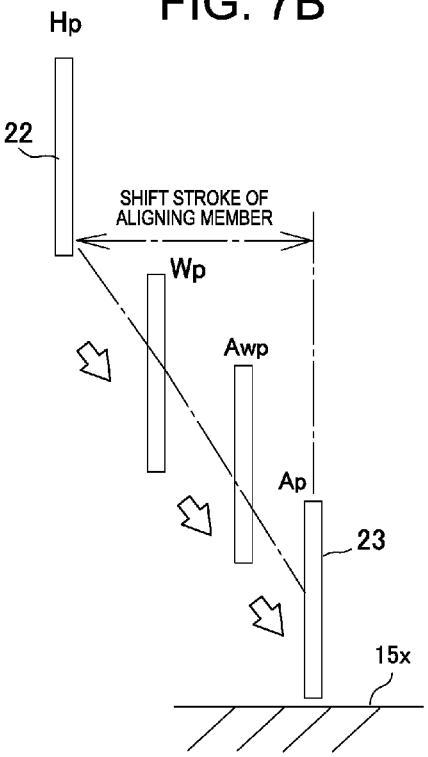

Control is performed with downward operation and width-aligning operation of the aligning member 22, the rotation amount of the turn motor M1 described previously, and rotation amounts of the left and right side shift motors M2, M3 by the control section 50. As shown in FIG. 7B, rotation control of both of the motors M2, M3 is controlled with a trajectory that the aligning member 22 performs downward operation from the waiting position Wp, and concurrently or after a predetermined time (which may be varied with the sheet size or type), performs width-aligning operation to shift to the aligning position Ap.

Figure 7C:
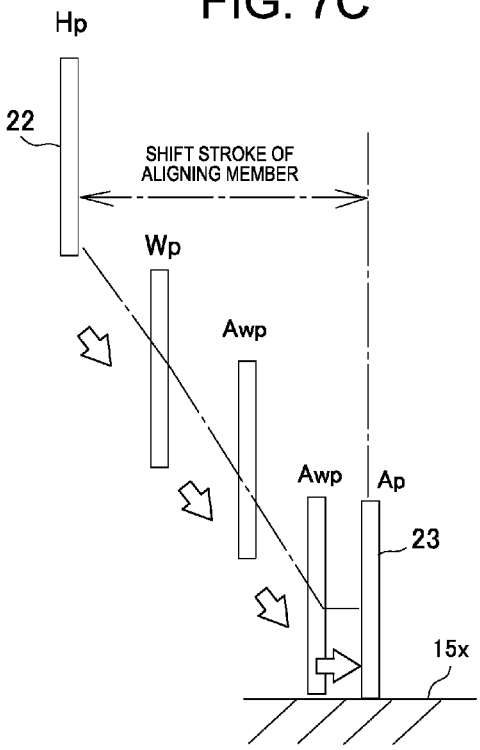

For this, the rotation amount of the turn motor M1 and rotation amounts of the side shift motors M2, M3 are controlled with predetermined functions (for example, linear function). Alternatively, as shown in FIG. 7C, it is controlled so that the aligning member 22 moves downward concurrently with the width-aligning operation, and after landing onto the load surface 15*x*, shifts to the aligning position Ap along the load surface (St12 to St15).

After finishing the aligning operation of the sheet (St15), the control section 50 shifts the aligning member 22 from the aligning position Ap to the waiting position Wp to prepare for sheet discharge operation of a subsequent sheet (St16). Next, the control section 50 determines whether or not a subsequent sheet exists (St17), and when the subsequent sheet does not exist, finishes storage operation (St18). On the other hand, when the subsequent sheet exists, the section 50 returns to step St08 to execute the same sheet discharge operation as described above.

"Jog Sort Mode"

When the control section 50 receives a command signal of the jog sort mode, the section shifts the position of the aligning member 22 from the home position Hp to the waiting position Wp corresponding to the sheet size. Next, the control section 50 aligns the sheet fed from the sheet discharge outlet 16*x* in the first reference position Alp as in the sheet discharge operation described previously (St19, St20).

Then, upon receiving a job end signal from the image formation apparatus A, the control section 50 aligns a sheet fed subsequently in the second reference position Ap2 (St21, St22). Then, the control section 50 determines whether or not a subsequent sheet exists (St23), and when the subsequent sheet exists, returns to step St19 to repeat the same operation, while when the subsequent sheet does not exist, finishing the storage operation (St24).

The invention claimed is:

1. A sheet collection apparatus comprising:

a transport path including a sheet discharge outlet;

a tray member that is disposed on a downstream side of the sheet discharge outlet and that includes a load surface for loading sheets;

a regulation member disposed in the tray member to regulate a position of an end edge in a transport direction of a sheet;

an aligning member disposed on an upper part in a load area of the load surface in the transport direction of the sheet, and including a side edge engagement surface that engages a side edge in a sheet width direction on the load surface, and a plurality of swing support portions including a first swing support portion having a rotation center, and a second swing support portion adjacent to the first swing support portion, the aligning member rotating about the rotation center of the first swing support portion to cause the side edge engagement surface to be rotated about the second swing support portion, and a shift section adapted to shift the side edge engagement surface between a waiting position and an aligning position, wherein the shift section shifts the aligning member from the aligning position to the waiting position in a shift trajectory that the side edge engagement surface displaces the sheet to the regulation member.

2. The sheet collection apparatus according to claim 1, wherein the aligning member is comprised of a pair of aligning members each including the side edge engagement surface, and the shift section shifts the pair of aligning members to positions in a vertical direction of the load surface and in the sheet width direction.

3. The sheet collection apparatus according to claim 2, wherein the load surface of the tray member is comprised of an inclined surface gradually lowering in a carry-in direction of a sheet fed from the sheet discharge outlet, the regulation member is disposed in a position for striking and regulating a front end portion in the sheet carry-in direction of the sheet, and in the aligning member the aligning position is positioned on an upstream side in the carry-in direction of the sheet, while the waiting position is positioned on a downstream side therein, and the shift section swings and shifts the aligning member from the aligning position on the upstream side in the carry-in direction of the sheet to the waiting position on the downstream side.

4. The sheet collection apparatus according to claim 3, wherein the aligning member further comprises an aligning portion including the side edge engagement surface, and the rotation center of the first swing support portion is positioned on the upstream side in the carry-in direction of the sheet from the sheet discharge outlet to the load surface, and the side edge engagement surface of the aligning portion is positioned on the downstream side therein.

5. The sheet collection apparatus according to claim 4, wherein the aligning position is set at a predetermined position on the load surface, and the waiting position is set at a position spaced a distance away from the aligning position in each of the sheet width direction and a sheet load direction.

6. The sheet collection apparatus according to claim 5, further comprising:

a control section adapted to control the shift section, wherein when the control section shifts the aligning member from the aligning position to the waiting position, the control section shifts the side edge engagement surface in the load direction, and then, shifts in the sheet width direction.

7. The sheet collection apparatus according to claim 5, further comprising:

a control section adapted to control the shift section, wherein when the control section shifts the aligning member from the aligning position to the waiting position, the control section shifts the side edge engagement surface so that a shift in the sheet width direction is performed later or at a lower velocity than a shift in the load direction.

8. The sheet collection apparatus according to claim 2, further comprising an apparatus frame axially supporting the first swing support portion, wherein each of the pair of aligning members comprises a base end arm portion having one end portion axially supported to the apparatus frame through the first swing support portion, and a front end aligning portion rotatably connected to another end portion of the base end arm portion through the second swing support portion and having the side edge engagement surface.

9. The sheet collection apparatus according to claim 1, wherein in the aligning member is formed a guide surface for supporting a lower surface of a subsequent sheet carried out of the sheet discharge outlet in the waiting position.

10. A sheet collection apparatus comprising:

a transport path including a sheet discharge outlet;

a tray member that is disposed on a downstream side of the sheet discharge outlet and that includes a load surface for loading sheets;

a regulation member disposed in the tray member to regulate a position of an end edge in a transport direction of a sheet;

an aligning member including a side edge engagement surface that engages a side edge in a sheet width direction on the load surface, and a couple pin about which the side edge engagement surface rotates; and a shift section adapted to shift the side edge engagement surface between a waiting position and an aligning position, wherein the shift section has a swing main shaft arranged adjacent to the couple pin of the aligning member and rotating the aligning member on an upper part of the tray member, the aligning member rotates about the swing main shaft to cause the side edge engagement surface to be rotated about the couple pin, and the side edge engagement surface moves from the aligning position to the waiting position by rotating the aligning member towards the regulation member.

* * * * *